United States Patent [19]

Schindel

[11] 3,990,582

[45] Nov. 9, 1976

[54] HANGER ROD ASSEMBLY

[75] Inventor: Morton Schindel, Weston, Conn.

[73] Assignee: Monaco, Georgetown, Conn.

[22] Filed: Mar. 28, 1975

[21] Appl. No.: 563,193

[52] U.S. Cl. ..... 211/105.1; 248/251

[51] Int. Cl.[2] ..... A47H 1/02

[58] Field of Search ..... 108/29, 31; 248/214, 248/251, 235, 247, 243, 201; 211/89, 90, 123, 124, 105.1

[56] References Cited

UNITED STATES PATENTS

| | | | |
|---|---|---|---|
| 774,968 | 11/1904 | McKee | 248/251 |
| 3,223,371 | 12/1965 | Miller | 248/251 |
| 3,350,856 | 11/1967 | Revell | 248/251 |
| 3,685,662 | 8/1972 | Varon et al. | 211/105.1 |
| 3,865,336 | 2/1975 | Robertson | 108/29 X |

FOREIGN PATENTS OR APPLICATIONS

| | | | |
|---|---|---|---|
| 1,213,698 | 11/1959 | France | 211/96 |

*Primary Examiner*—Roy D. Frazier
*Assistant Examiner*—Terrel P. Lewis
*Attorney, Agent, or Firm*—St. Onge Mayers Steward & Reens

[57] ABSTRACT

A hanger rod assembly is described wherein a hanger rod may be conveniently horizontally supported from wall mounted brackets. The hanger rod assembly includes a pair of clamps which grip brackets and ends of a hanger rod in a conveniently applied manner. The clamps each include clamp elements shaped to retain the hanger rod ends while tightly engaging the brackets for support of the hanger rod.

2 Claims, 5 Drawing Figures

Fig. 1.
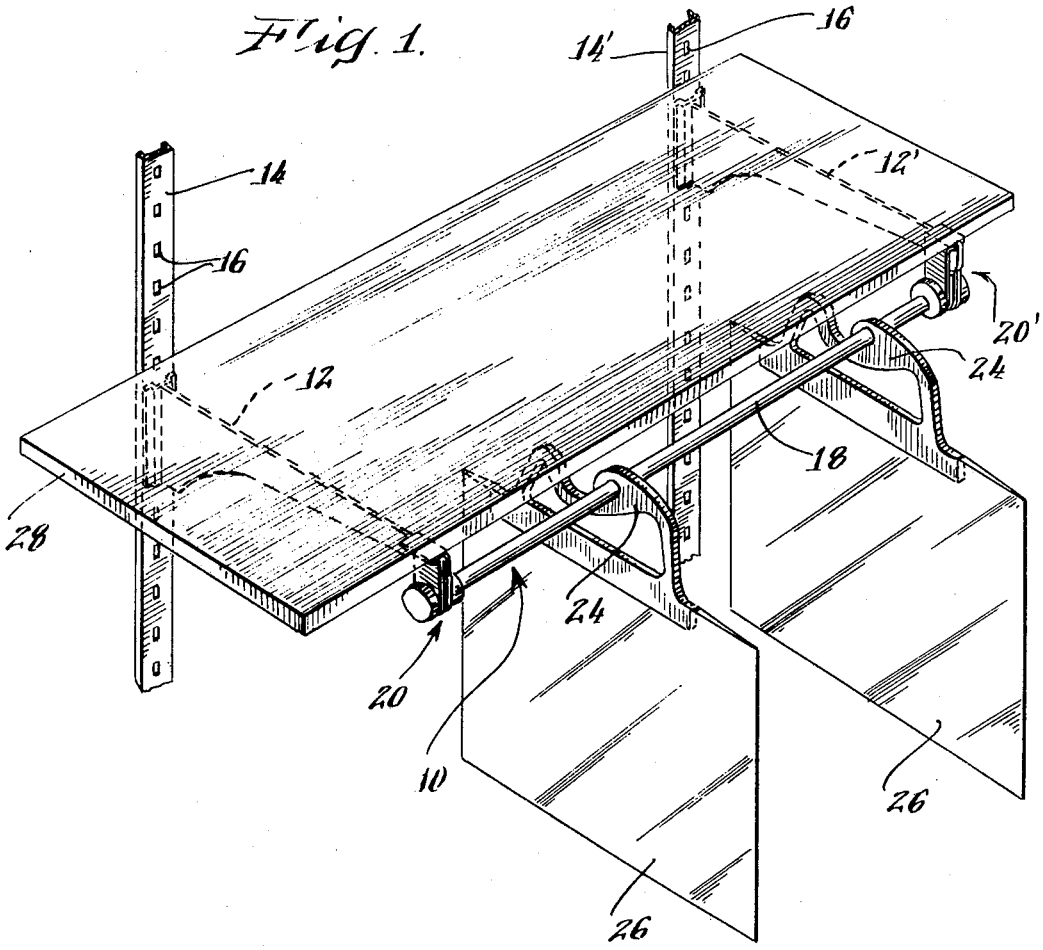
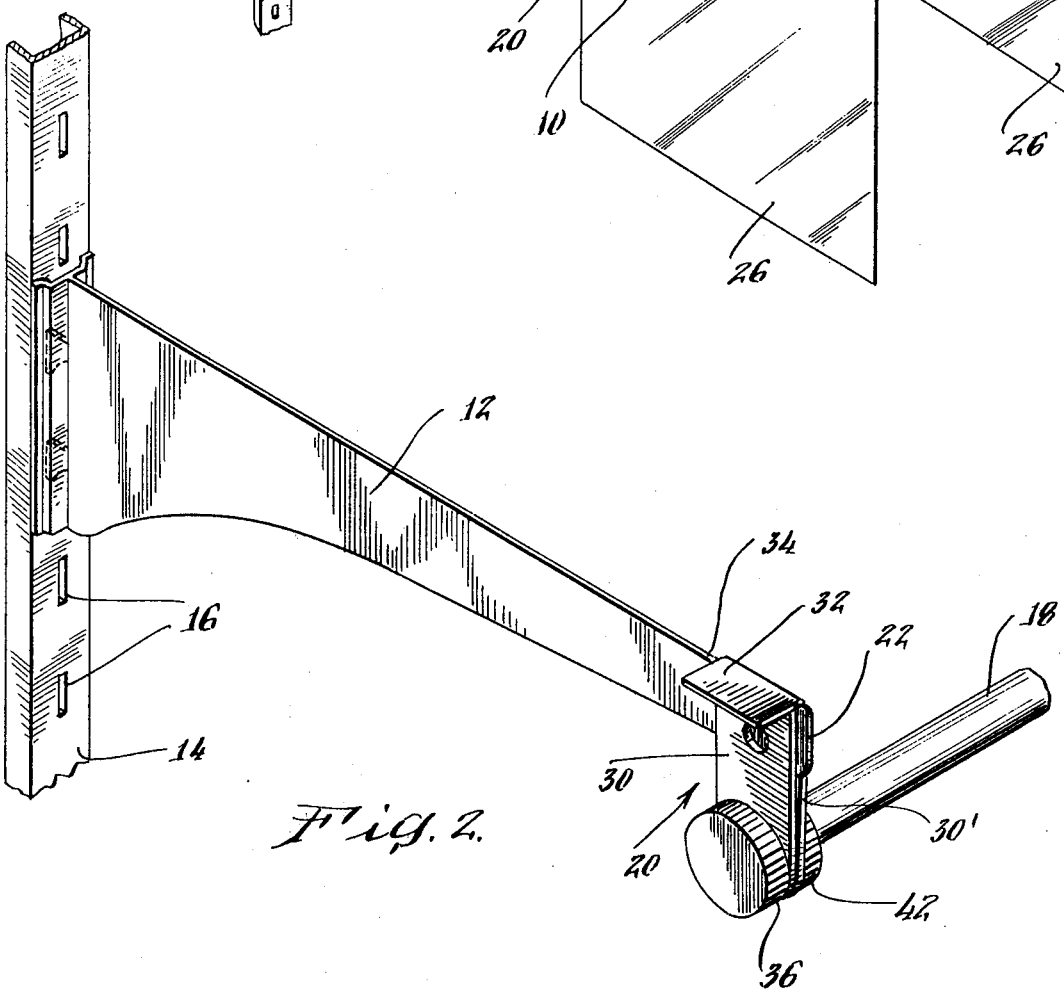
Fig. 2.

Fig. 3.
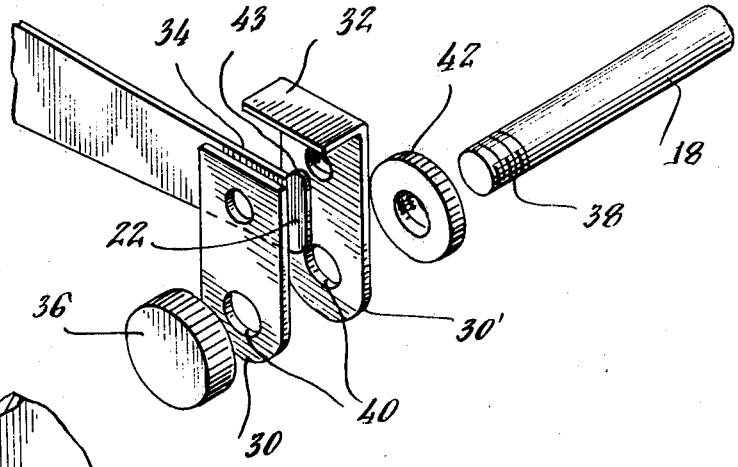
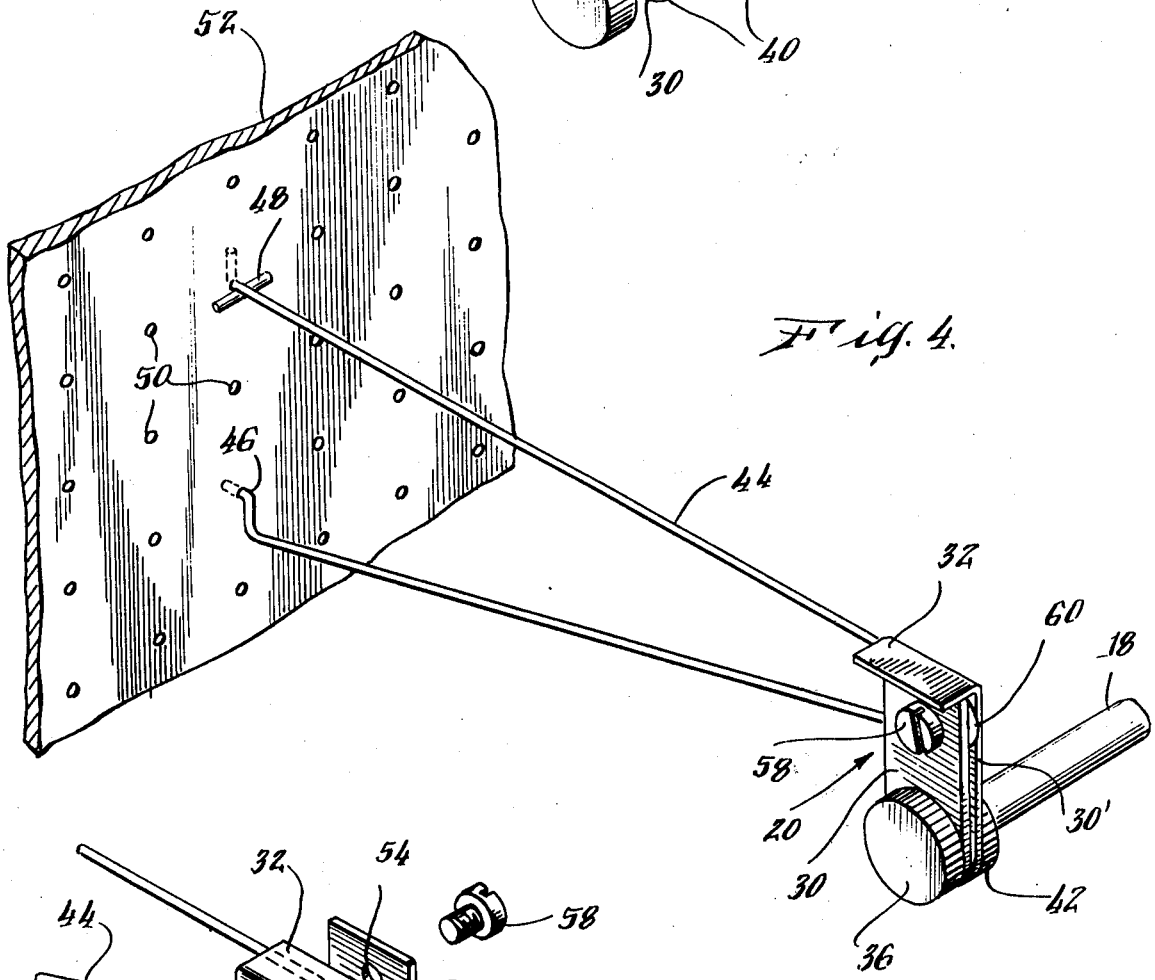
Fig. 4.
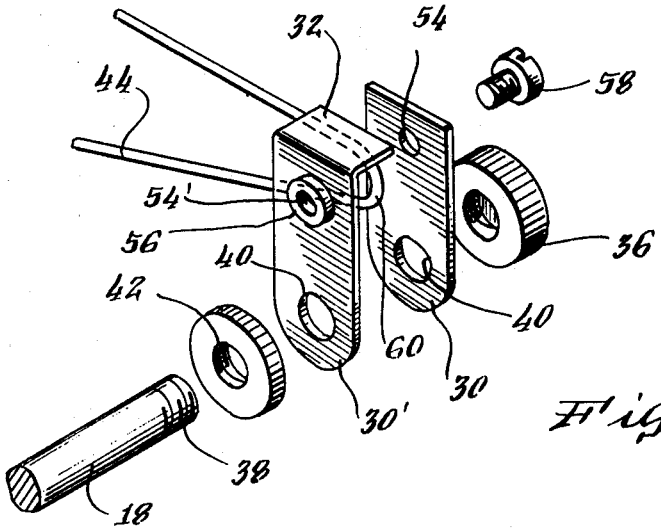
Fig. 5.

HANGER ROD ASSEMBLY

FIELD OF THE INVENTION

The present invention relates to a hanger rod assembly suitable for storing merchandise display bags and the like.

BACKGROUND OF THE INVENTION

The use of quickly installed brackets for book shelves and the like is well known. The brackets may be installed on vertical wall mounted channels or in holes formed in a pegboard attached to a wall.

Display racks for merchandise often require a horizontal bar to enable display articles to be suspended with hangers.

SUMMARY OF THE INVENTION

With a hanger rod assembly in accordance with the invention, a pair of quickly applied clamps are used to affix a hanger rod in a horizontal manner from brackets which extend from a wall. The clamps are each formed of a pair of mating clamp elements shaped to retain ends of the hanger rod and firmly engage the brackets.

In one form of an embodiment for a hanger assembly in accordance with the invention, brackets are used having a wire structure shaped to engage holes in a pegboard serving as a wall. The clamp elements are provided with suitable apertures to engage ends of the brackets.

In another form of a hanger assembly in accordance with the invention, conventional solid book shelf brackets are used. The ends of the brackets are located between clamp elements, one of which is provided with a lip shaped to overly an edge at the ends of the brackets for firm adherence thereto.

With a hanger rod assembly in accordance with the invention, one may quickly and easily connect components. The hanger rod assembly may be conveniently installed in areas where a pegboard or vertical bracket channel supports are available.

Accordingly, it is an object of the invention to provide a hanger rod assembly which is convenient to put together and install.

Other objects and advantages of a hanger rod assembly in accordance with the invention will be understood from a detailed description of several embodiments described with reference to the drawings.

BRIEF DESCRIPTION OF THE DRAWINGS

FIG. 1 is a perspective view of a complete hanger rod assembly in accordance with the present invention;

FIG. 2 is an enlarged perspective view of a portion of the hanger rod assembly as shown in FIG. 1;

FIG. 3 is an exploded perspective view of components used in the hanger rod assembly shown in FIG. 1;

FIG. 4 is an enlarged perspective view of an alternate embodiment for a portion of a hanger rod assembly in accordance with the invention; and FIG. 5 is an exploded perspective view of the hanger rod assembly portions shown in FIG. 4.

DESCRIPTION OF EMBODIMENTS

With reference to FIGS. 1 and 2, a hanger rod assembly 10 in accordance with the invention, is shown mounted between two mounting brackets 12—12′. Brackets 12 may be of the conventional shelf supporting type. Brackets 12 extend in cantilever fashion from vertically oriented wall mounted channels 14—14′ by engaging slots such as 16.

The assembly 10 is formed of a hanger rod 18 and a pair of clamps 20—20′ which retain ends of the hanger rod 18 and firmly engage ends 22 of brackets 12. The hanger rod 18 is shaped and located in such manner as to receive and support hooks 24 attached to 26. A transparent shelf 28 is shown resting on brackets 12.

Each clamp 20 is formed of a pair of flat mating clamp elements 30—30′. One clamp element 30′ is L-shaped and provided with a lip 32 sized and shaped to overly the upper edge 34 of the bracket 12 and the other clamp element 30. The clamp elements 30—30′ receive the threaded end 38 of the hanger rod 18 (see FIG. 3) and are held together by a knurled collar 36 screwed on to end 38 as shown in FIG. 2.

As illustrated in FIG. 3, each clamp element 30 is provided with an aperture 40 shaped and sized to receive the threaded end 38 of hanger rod 18. The apertures 40 may be in the form of a slot and align with each other below end 22 of bracket 12. A collar 42 is provided to screw onto end 38 of hanger rod 18 and enable knurled collar 36 to firmly squeeze the clamp elements 30—30′ together.

The vertical protrusion 43 on bracket end 22 helps to retain the clamp 20 on bracket 12. However, sufficient clamping force can be applied with clamp 20 to inhibit sliding off the bracket 12.

With reference to FIGS. 4 and 5, a clamp 20 is shown for use with a conventional pegboard bracket 44. Bracket 44 is of the wire type with ends 46, 48 shaped to engage holes 50 in a vertical pegboard 52. Board 52 may be attached to a wall or free standing with conventional supports (not shown).

Clamp elements 30—30′ are provided with apertures 54—54′, one of which is effectively threaded or carries a lock nut 56 to receive a screw 58. The apertures 54—54′ are aligned so that clamp elements 30 may engage end 60 of bracket 44 when screw 58 is applied as shown in FIG. 4. The closed end 60 of wire shaped bracket 44 serves to aid in inhibiting dislodgement of the clamp 20 from bracket 44.

Having thus described a hanger rod assembly in accordance with the invention, its advantages can be appreciated. The hanger rod assembly may be quickly assembled and installed. Variations of the variously described components may be employed. For example, the hanger rod 18 may be threaded over its entire length to enable attachment of clamps 20 at any point with suitable lock nuts. The hanger rod assembly is advantageously compatible with existing hardware brackets employed with pegboards and book shelf bracket mountings.

What is claimed is:

1. In a hanger rod assembly wherein a pair of brackets is used with shapes to extend in cantilever fashion from a wall to enable a hanger rod to be horizontally supported at a distance from the wall as determined by the length of the brackets, the improvement comprising a hanger rod;

a pair of clamps, each clamp being formed of mating clamp elements, said clamp elements being selectively shaped to retain an end of the hanging rod at one end of the elements and being further shaped to clampingly engage the brackets at another end of the elements;

wherein one of the clamp elements in each pair is provided with a support lip sized to engage an upper edge of the bracket to suspend the hanger rod from the brackets, wherein the clamp elements are each provided with an aperture sized to receive a threaded end of the hanger rod; and closure collars which are threaded to mesh with the threaded hanger rod ends to squeeze the clamp elements between collars and tightly grip the brackets to affix the hanger rod to the brackets.

2. The improved hanger rod assembly as claimed in claim 1 wherein one of the clamp elements in each pair is provided with a threaded element and the other clamp element has a corresponding aperture with the locations of the threaded element and the corresponding aperture being selected to enable gripping engagement of an intermediately located bracket upon the applications of a screw.

* * * * *